US007003994B2

(12) United States Patent
Ruan

(10) Patent No.: US 7,003,994 B2
(45) Date of Patent: Feb. 28, 2006

(54) LOCK ENHANCING DEVICE

(75) Inventor: Jiaqiang Ruan, Kowloon (HK)

(73) Assignee: Path Line (NG's) Holding Limited, Kowloon (HK)

( * ) Notice: Subject to any disclaimer, the term of this patent is extended or adjusted under 35 U.S.C. 154(b) by 48 days.

(21) Appl. No.: 10/703,370

(22) Filed: Nov. 7, 2003

(65) Prior Publication Data

US 2005/0097933 A1 May 12, 2005

(51) Int. Cl.
*E05B 63/00* (2006.01)
*E05B 17/04* (2006.01)

(52) U.S. Cl. ..... 70/416; 70/370; 70/379 R

(58) Field of Classification Search ..... 70/493, 70/379–380, 224, 370, 372, 379 R, 379 A, 70/416–417, DIG. 29
See application file for complete search history.

(56) References Cited

U.S. PATENT DOCUMENTS 1,929,658 A * 10/1933 Solliday ..... 70/379 R
2,042,025 A * 5/1936 Schlage ..... 70/379 R
3,739,612 A * 6/1973 Schultz ..... 70/380
4,672,828 A * 6/1987 Theriault ..... 70/380
4,703,638 A * 11/1987 Bergstrom ..... 70/379 R
4,793,166 A * 12/1988 Marks ..... 70/379 R
5,269,162 A * 12/1993 Robida et al. ..... 70/379 R
5,685,184 A * 11/1997 Gallagher ..... 70/379 R
5,884,512 A * 3/1999 Wayne ..... 70/379 R
6,644,076 B1 * 11/2003 Huang ..... 70/379 R

* cited by examiner

*Primary Examiner*—Daniel P. Stodola
*Assistant Examiner*—Christopher Boswell
(74) *Attorney, Agent, or Firm*—Raymond Y. Chan; David and Raymond

(57) ABSTRACT

A lock enhancing device for a key comprising a lock core having a cylindrical core body with a first retaining groove formed on a rear core end and a lock sleeve having with a rear housing end comprises an axial movement stopper formed as a C-shaped ring having an inner stopper circumferential surface and outer stopper circumferential surface. The inner stopper circumferential surface and outer stopper circumferential surface is capable of being disposed in relation with the lock core and core sleeve in such a manner that the inner stopper circumferential surface engages with the first retaining groove while the outer stopper circumferential surface presses against the rear housing end of core sleeve in order to enhance structural resistance against an axial force for pulling the lock core out of the lock sleeve.

14 Claims, 4 Drawing Sheets

LOCK ENHANCING DEVICE

BACKGROUND OF THE PRESENT INVENTION

1. Field of Invention

The present invention relates to a lock comprising a lock core and lock sleeve, and more particular to a lock enhancing device disposed in relation with the lock core and lock sleeve for enhancing the structural resistance for the lock core against an axial force for pulling the lock core out of the lock sleeve.

2. Description of Related Arts

A lock is widely used in houses, vehicles, cabinets, drawers and security boxes for safety purposes. Many types of locks, such as key-type locks, secret-code-type locks and electric-signal-triggered locks, have been developed to satisfy various needs. Among them, the key-type locks remain the most commonly adopted kind for their inexpensive costs and ease of installation. They may be readily found in houses, offices and other facilities.

A traditional key-type lock is basically composed of a lock core, lock sleeve and transmission lever. The lock core includes a key receptacle for receiving the key therein. The lock sleeve has a set of tumbler barrels communicating with the key receptacle as the lock core is inserted into the lock sleeve. Pressure springs and tumblers are disposed in the tumbler barrels to form a secret code that would block the relative rotation movement between the lock core and lock sleeve, when no key or an incorrect key is inserted into the key receptacle. Yet, when the correct key is inserted, the teeth of the key will push the tumblers to a position that allows the lock core to rotate with respect to the lock sleeve. The transmission lever is connected to the lock core in such a manner when the correct key turns the lock core to rotate, it accordingly drives the transmission lever to rotate in order to active a lock bolt to a lock or unlock position. Such lock can be found, for example, in U.S. Pat. No. 2,814,941 entitled "Lock Core" to Frank Ellison Best on Dec. 3, 1957.

One drawback of the abovementioned lock is its structural weakness in resisting an axial force that is applied to pull the lock core out of the lock sleeve. The lock core is externally threaded at its end in correspondence with a cap nut that is internally threaded. The nut cap has an inner diameter smaller than that of the lock sleeve and an outer diameter greater than the same so that when it engages the lock core received in the lock sleeve, it blocks the axial movement of the lock core with respect to the lock sleeve. However, the engagement of the cap nut and lock cores provides limited restraint to their relative axial movement. A rather great force may be able to pull the lock core out of the lock sleeve and render the lock ineffective.

Although the tumblers help resist against the axial force for pulling the lock core out of the lock sleeve, they may yield in certain circumstances. Because the tumblers are retained in the tumbler barrels with pressure springs, they can move along the barrels by pressing the springs and release the lock core to rotate with respect to the lock sleeve—an action usually happens when a correct key is inserted into the key receptacle. However, this may happen when an exceptional large axial force is applied to pull to lock core out of the lock sleeve. When the axial force is large enough, the interface between the lock core and tumbler barrels may deform. As a result, the tumblers may be pushed upward along the tumbler barrels and finally give way to the axial force.

In order to cope with this issue, the Builders Hardware Manufacturers Association (BHMA) accredited by the American National Standards Institution (ANSI) has develop a standard for lock core in resisting the axial force to remain structural integrity. The standard defines three classes: the third class is 2300N resistance; the second class is 4800N resistance; and the first class is 11000N resistance. Of course, the lock passes the tests of the first class resistance is safer than the ones passing the tests of lower classes in terms of resisting the axial force that is applied to pull the lock core out of the lock sleeve.

SUMMARY OF THE PRESENT INVENTION

An objective of the present invention is to provide a lock enhancing device for a key that comprises a lock core having a first retaining groove and lock sleeve for fittedly receiving the lock core, wherein the lock enhancing device is formed as a C-shaped ring having a inner stopper circumferential surface and outer stopper circumferential surface, wherein the lock enhancing device is disposed in relation with the lock core and lock sleeve in such a manner that the inner stopper circumferential surface engages with the first retaining groove while the outer stopper circumferential surface presses against an rear end of lock sleeve to enhance the structural resistance against an axial force for pulling the lock core out of the lock sleeve.

Another objective of the present invention is to provide a lock enhancing device for a key that comprises a lock core having a first retaining groove, wherein the lock enhancing device is formed as a C-shaped ring having a ring opening that enables the lock enhancing device to deform in order to flexibly widen the ring opening for facilitating the engagement of the lock enhancing device with the first retaining groove of lock core.

Another objective of the present invention is to provide a lock enhancing device for a key that comprises a lock core having a first retaining groove on which a positioning recess is formed into the lock core, wherein the lock enhancing device is formed as a C-shaped ring having a protruded portion adapted for fittedly engaging with the positioning recess, whereby the lock enhancing device is capable of engaging with the first retaining groove without substantially movement with respect to the lock core by virtue of the engagement of the protruded portion and the positioning recess.

Another objective of the present invention is to provide a lock enhancing device for a key that comprises a lock core having a reinforcement receptacle coaxially formed in an rear end of the lock core, and a lock sleeve for fittedly receiving the lock core, wherein the lock enhancing device comprises a structure-reinforcing element adapted for fittedly placing in the reinforcement receptacle for resisting radial deformation of the lock core as an axial force is applied to pull the lock core out of the lock sleeve.

Another objective of the present invention is to provide a lock comprising a lock core, lock sleeve receiving the lock core and lock enhancing device that comprises a C-shaped axial movement stopper having a inner stopper circumferential surface and outer stopper circumferential surface, wherein the lock enhancing device is disposed with the lock core and lock sleeve in such a manner that the inner stopper circumferential surface engages with a first retaining groove of lock core while the outer stopper circumferential surface presses against an rear end of lock sleeve to enhance the structural resistance against an axial force for pulling the lock core out of the lock sleeve.

Another objective of the present invention is to provide a lock comprising a lock core, lock sleeve receiving the lock core comprising a reinforcement receptacle coaxially formed in an rear end of the lock core, and a structure-reinforcing element fittedly placed in the reinforcement receptacle for resisting radial deformation of the lock core as an axial force is applied to pull the lock core out of the lock sleeve.

The present invention discloses a lock enhancing device for a key comprising a lock core having a cylindrical core body with a first retaining groove formed on a rear core end of said core body and a lock sleeve having a core housing with a rear housing end of said core housing defining a core chamber for fittedly receiving said core body therein, wherein said lock enhancing device comprises: an axial movement stopper formed as a C-shaped ring having an inner stopper circumferential surface and outer stopper circumferential surface, said inner stopper circumferential surface and said outer stopper circumferential surface having a distance greater than the depth of said first retaining groove, and said inner stopper circumferential surface having a curvature substantially identical to that of said first retaining grove, wherein said axial movement stopper is capable of being disposed in relation with said core body and said core housing in such a manner that said inner stopper circumferential surface engages with said first retaining groove while said outer stopper circumferential surface presses against said rear housing end of said core housing in order to enhance structural resistance against an axial force for pulling said lock core out of said lock sleeve.

The present invention further discloses a lock for operation with a key to activate a key bolt, featured in resisting an axial force to maintain structural integrity, comprising: a lock core having a cylindrical core body with a rear core end and a key receptacle for receiving said key defined therein, wherein an external thread is formed on said rear core end inwardly from an rear core edge of said rear core end and a first retaining groove is formed adjacent to said external thread at said rear core end; a lock sleeve having a core housing with a rear housing end defining a core chamber for fittedly receiving said core body therein, and a fin extending from said core housing having tumbler barrels communicating with said core chamber, wherein a plurality of coded tumblers are disposed in said tumbler barrels in such a manner that as said key is inserted into said key receptacle, said coded tumblers are placed at a position allowing said lock core to rotate with respect to said core sleeve; a transmission lever connected to said lock core in such a manner that said core body drives said transmission lever to rotate simultaneously for activating said key bolt; a lock enhancing device comprising an axial movement stopper formed as a C-shaped ring having an inner stopper circumferential surface and outer stopper circumferential surface, said inner stopper circumferential surface and said outer circumferential stopper surface having a distance greater than the depth of said first retaining groove and said inner stopper circumferential surface having a curvature substantially identical to that of said first retaining grove, wherein said axial movement stopper is disposed in relation with said core body and said core housing in such a manner that said inner stopper circumferential surface engages with said first retaining groove while said outer stopper circumferential surface presses against said rear housing end; and a cap nut having a cylindrical circumferential wall with an inner cap surface defining a lever-receiving opening for receiving said transmission lever therethrough, wherein a second retaining groove is formed on a front cap edge of said inner cap surface and an internal thread is formed adjacent to said second retaining groove thereon, such that said cap nut is affixed to said rear core end of said core body with said internal thread engaging said external thread in such a manner that said outer stopper circumferential surface of said axial movement stopper is disposed within said second retaining groove, thereby enhancing structural resistance against said axial force for pulling said lock core out of said lock sleeve.

These and other objectives, features, and advantages of the present invention will become apparent from the following detailed description, the accompanying drawings, and the appended claims.

DETAILED DESCRIPTION OF THE PREFERRED EMBODIMENT

Figure 1:
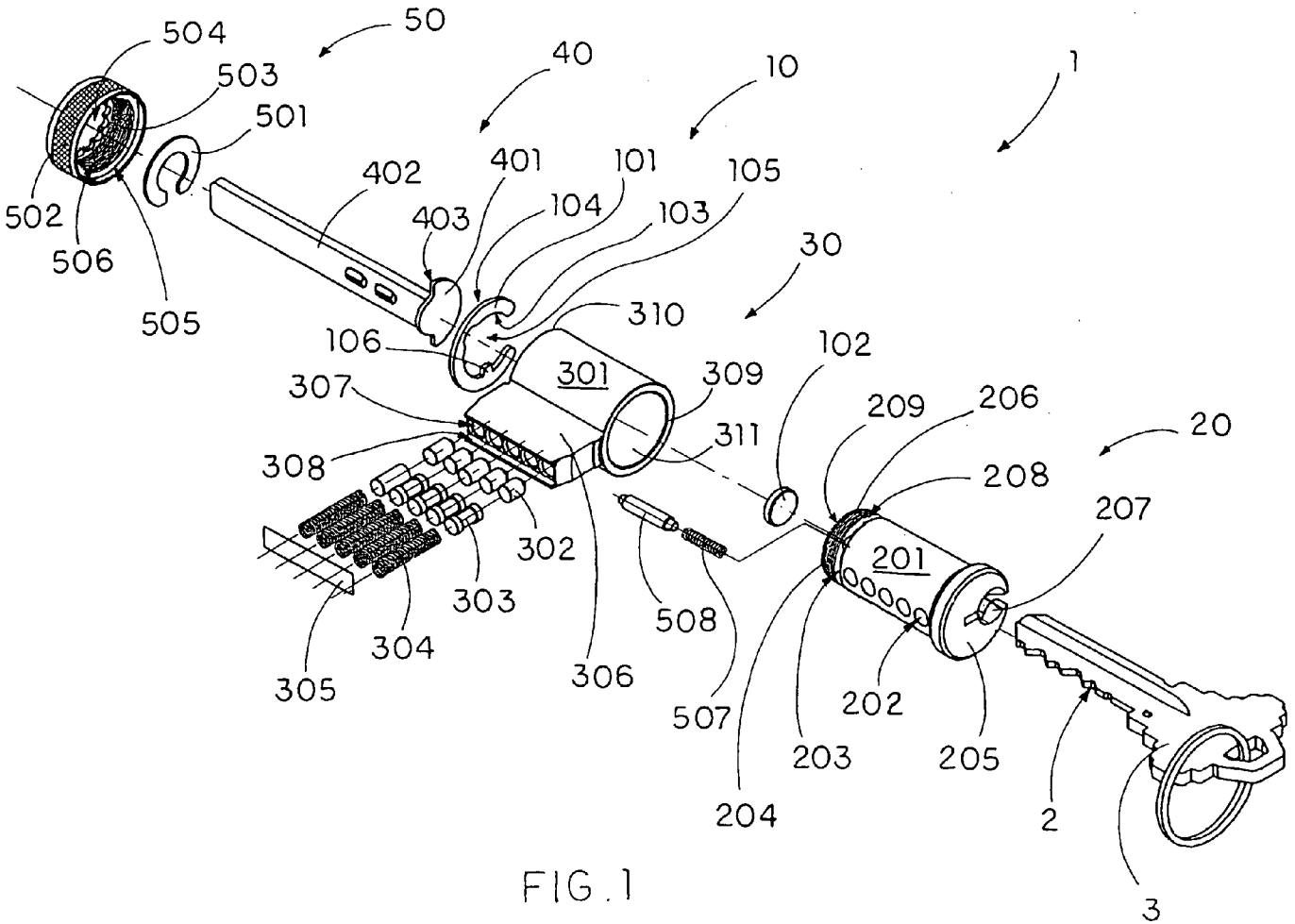
FIG. 1 is an exploded view of a lock adopting the proposed lock enhancing device according to a preferred embodiment of the present invention.
Figure 2:
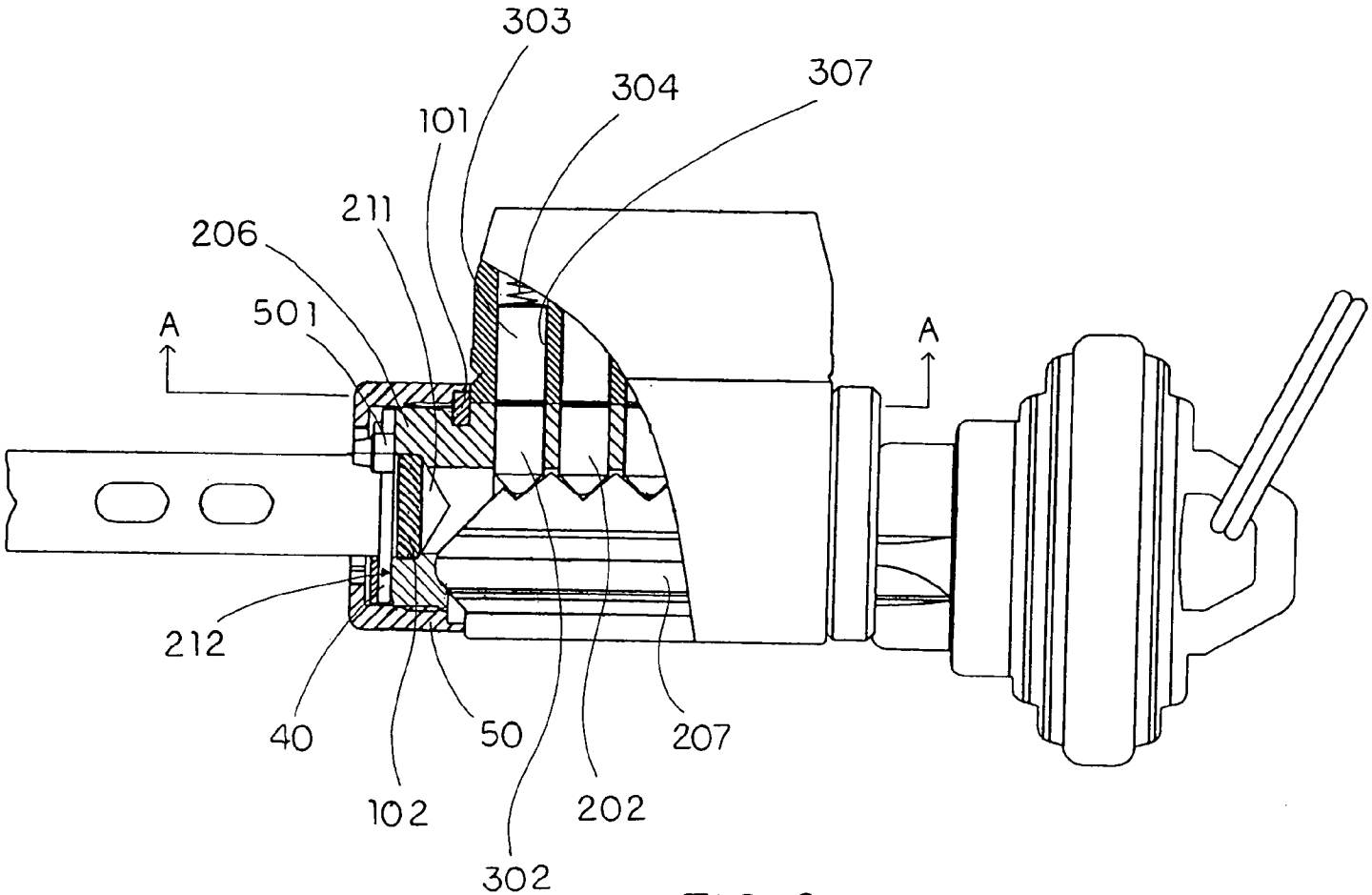
FIG. 2 is a partially cross-sectional view of the lock that adopts the proposed lock enhancing device according to a preferred embodiment of the present invention.

Referring to FIG. 1 and FIG. 2, the lock 1 that adopts the proposed lock enhancing device 10 is illustrated according to a preferred embodiment of the present invention. The lock 1 comprises a lock core 20, lock sleeve 30, transmission lever 40, cap nut 50 and lock enhancing device 10. The clock core 20 is fittedly inserted into the lock sleeve 30 and axially affixed therein partially by virtue of the cap nut 50. The transmission lever 40 is disposed between the lock core 20 and the cap nut 50 in such a manner that it rotates simultaneously with the lock core 20. The lock enhancing device 10 is disposed in relation with the lock core 20 and lock sleeve 30 for resisting against an axial force for pulling the lock core 20 out of the lock sleeve 30.

The lock core 20 comprises a cylinder core body 201, tumbler bores 202, first retaining groove 203 and external thread 204. The core body 201 having a front core end 205 and rear core end 206 defines a key receptacle 207 for receiving a key therein. The external thread 208 is formed inwardly from the rear core edge 209 of the rear core end 206. The first retaining groove 203 is formed adjacent to the external thread 208 at the rear core end 206. A plurality of tumbler bores 202 are provided to the core body 201 in communication with the key receptacle 207. The front core end 205 has a diameter greater than that of the rear core end 206 for setting a limit for the insertion of the lock core 20 into the lock sleeve 30.

The lock sleeve 30 comprises a core housing 301, a plurality of first tumblers 302, a plurality of second tumblers 303, a plurality of tumbler springs 304 and tumbler cap 305. The core housing 301 is shaped as a cylindrical tube with a fin 306 radially protruding therefrom, in which a plurality of tumbler barrels 307 are formed. The first tumblers 302, second tumblers 303 and tumbler springs 304 are respectively disposed and retained in the tumbler barrels 307 with the tumbler cap 305 sliding through a pair of side cuts 308 formed at the top of fin 306. The core housing 301 has a front housing end 309 and rear housing end 310 defining a core chamber 311, which communicates with the tumbler barrels 307. The core chamber 311 has a diameter substantially similar to that of the core body 201 to fittedly receive it therein, while enabling the lock core 20 to rotate with respect to the lock sleeve 30. The tumbler barrels 307 of lock sleeve 30 align with the tumbler bores 202 of lock core 20, so that the first tumblers 302 are capable of reaching the key receptacle 207 and moving along the tumbler bore 202 and tumbler barrels 307.

The lock enhancing device 10 comprises an axial movement stopper 101 and structure-reinforcing element 102 that are disposed in relation with the lock core 20 and lock sleeve 30. The axial movement stopper 101 is formed as a C-shaped ring having an inner stopper circumferential surface 103 and outer stopper circumferential surface 104. The curvature of axial movement stopper 101 corresponds to that of the first retaining groove 203 and the inner stopper circumferential surface 103 and outer stopper circumferential surface 104 has a distance greater than the depth of the first retaining groove 203. Thus, the axial movement stopper 101 is capable of being disposed in relation with the core body 201 and the core housing 301 in such a manner that the inner stopper circumferential surface 103 engages with the first retaining groove 203 while the outer stopper circumferential surface 104 presses against the rear housing end 310 of core housing 301.

Figure 3:
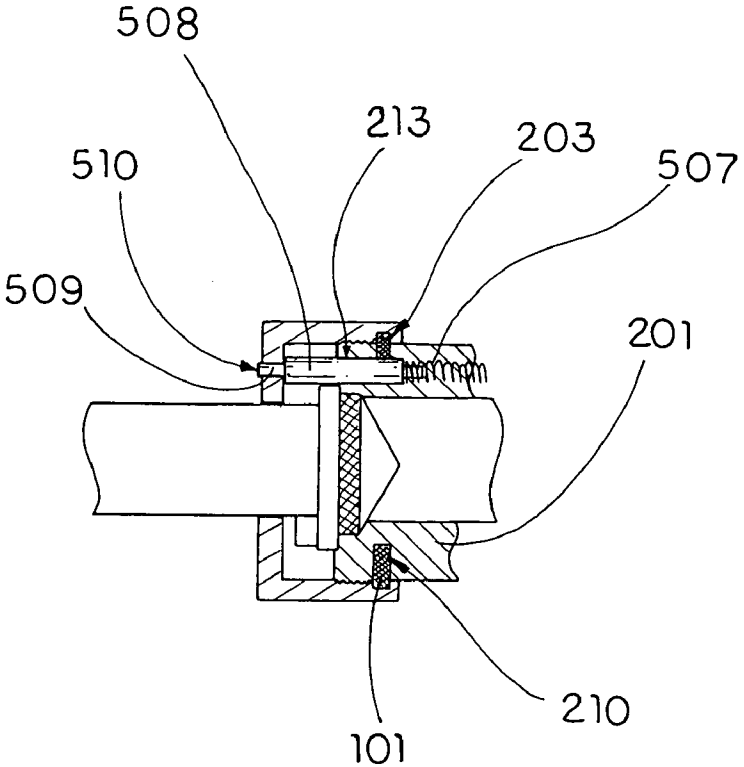
FIG. 3 is a partially cross-sectional view of the lock the lock that adopts the proposed lock enhancing device according to a preferred embodiment of the present invention.

Referring to FIG. 1 and FIG. 3, the axial movement stopper 101 has a ring opening 105 that enables the axial movement stopper 101 to deform in order to flexibly widen the ring opening 105 for facilitating the engagement of the axial movement stopper 101 with the first retaining groove 203 of core body 201. Furthermore, the axial movement stopper 101 has a protruded portion 106 adapted for fittedly engaging with a positioning recess 210 formed on the first retaining groove 203 into the core body 201. Thus, the axial movement stopper 101 is capable of engaging with the first retaining groove 203 without substantial rotation movement with respect to the core body 201 by virtue of the engagement of the protruded portion 106 and positioning recess 210.

Referring to FIG. 1 and FIG. 2, the structure-reinforcing element 102 is adapted for being fittedly placed in a reinforcement receptacle 211 formed into the rear core end of core body. The structure-reinforcing element 102 can be made of any material that is more inelastic than the core body 201 for resisting the rear core end 206 against deformation inwardly and radially.

The transmission lever 40 comprises a blocker plate 401 and elongated portion 402 coaxially extending therefrom. The blocker plate 401 has an outer blocker circumferential surface 403 corresponding to an end contour 212 of the rear core end 206 of core body 201. A ring-shaped blocking disc 501, which has an inner diameter smaller than that of the blocker plate 401 and greater than the width of the elongated portion 402, sandwiches the blocker plate 401 against the end contour 211 of rear core end 206 and prevents its departing therefrom.

The cap nut 50 having a cylindrical circumferential wall 502 with an inner cap surface 503 defines a lever-receiving opening 504 for receiving the transmission lever 40 therethrough. A second retaining groove 505 is formed on a front cap edge of the inner cap surface 503 and an internal thread 506 is formed adjacent to the second retaining groove 505 thereon. The cap nut 50 is affixed to the rear core end 206 of core body 201 with the internal thread 506 engaging the external thread 208 in such a manner that the outer stopper circumferential surface 104 of axial movement stopper 10 is disposed within the second retaining groove 505 of cap nut 50 and presses against the rear housing end 206 of core housing 201.

Referring to FIG. 1 and FIG. 3, a side groove 213 is provided at the rear core end 206 of core body 201. A pin spring 507 and locking pin 508 fittedly disposed on the side groove 213 with a pin tip 509 of locking pin 508 fittedly inserted into a pin hole 510 of cap nut 50 in order to block the relative rotation movement between the cap nut 50 and lock core 20.

How the lock 1 works and the lock enhancing device 10 functions to enhance structural resistance against an axial force for pulling the lock core out of the lock sleeve is described as the follows. Referring to FIG. 1 and FIG. 2, the first tumblers 302 and second tumblers 303 are coded in various lengths corresponding to the teeth 2 of key 3. In a lock position, the first tumblers 302 reach the key receptacle 207, while the second tumblers 303 cross the interface between the tumbler bores 202 of core body 201 and the tumbler barrels 307 of core housing 301, that is shown as the line A—A. When no key or an incorrect key is inserted into the key receptacle 207, there will always be any of the first tumblers 302 and second tumblers 303 blocking the interface between tumbler bores 202 and tumbler barrels 307, i.e., line A—A. As a result, the key core 20 is not able to rotate with respect to the core sleeve 30, so that the transmission lever 40 would remain in a lock position. When the correct key 3 is inserted into the key receptacle 207, its teeth 2 places the first tumblers 302 and second tumblers 303 at a position where their interfaces align with the interface between tumbler bores 202 and tumbler barrels 307. At such position, no tumbler would block the relative rotation movement between the lock core 20 and lock sleeve 30. Thus, the key 3 is able to turn the lock core 20 to rotate the transmission lever 40 to an unlock position.

When axial force is applied to pull the lock core 20 out of the lock sleeve 30, the axial movement stopper 101 enhances the structural resistance against such axial force for its inner stopper circumferential surface 103 is disposed on the first retaining groove 203 and its outer stopper circumferential surface 104 presses against the rear housing end 310. In addition, the structure-reinforcing element 102 resists the inward and radial deformation at the rear core end 206 that may be caused by the axial force, for the structure-reinforcing element 102 is more inelastic than the core body 201. Thus, the lock enhancing device 10, which comprises the axial movement stopper 101 and structure-reinforcing element 102, is able to help retain the lock core 20 within the lock sleeve 30 against an axial force.

Figure 4:
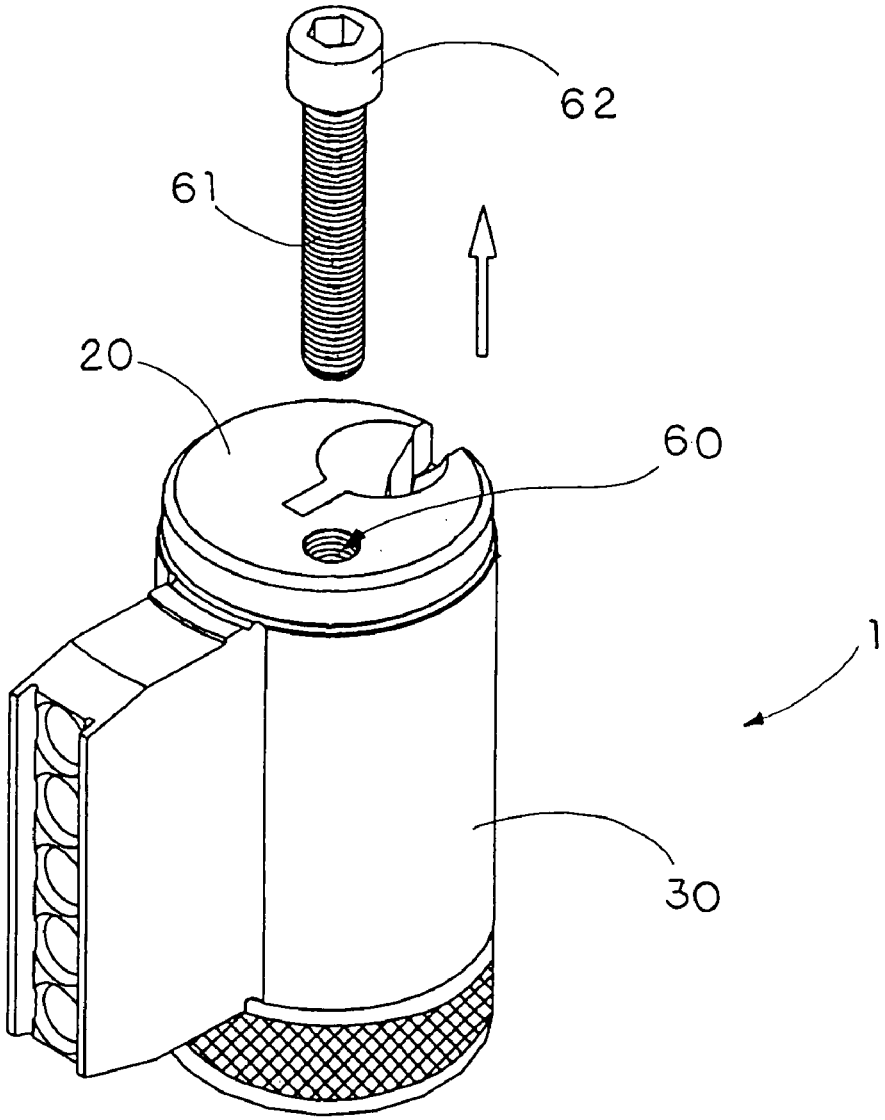
FIG. 4 is a perspective view illustrating that the above-mentioned lock is under a test for resistance against an axial force according to the BHMA/ANSI standard.

FIG. 4 illustrates a test for the structural resistance of the lock enhancing device as disclosed above against an axial force for pulling the lock core 20 out of the lock sleeve 30, according to the BHMA/ANSI standard. First, a testing barrel 60 is drilled on the front core end 205 into the core body 201 (see FIG. 1). The testing barrel 60 is threaded corresponding to a threaded testing bolt 61. Second, the testing bolt 61 is fastened into the testing barrel 60 to an extent that the head 62 of testing bolt 61 exposing from the front core end 205. Third, a power source is connected to the bolt head 62 to pull the lock core 20 out of the lock sleeve 30. In a test in which the components of the lock 1 are made of conventional materials, the result shows that the disclosed lock enhancing device resists an axial force over 11000N and therefore meets the first class requirement of the BHMA/ANSI standard. As a result, the disclosed lock enhancing device improves the safety feature of conventional locks in terms of resisting against an axial force for pulling the lock core 20 out of the lock sleeve 30.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without-departure from such principles. Therefore, this invention includes all modifications encompassed within the spirit and scope of the following claims.

What is claimed is:

1. A lock enhancing device for a key lock which comprises a lock core having a cylindrical core body with a first retaining groove formed on a rear core end of said core body and a key receptacle formed therein and a lock sleeve having a core housing with a rear housing end of said core housing defining a core chamber for receiving said core body therein, wherein said lock enhancing device comprises:

an axial movement stopper formed as a C-shaped ring having an inner stopper circumferential surface and outer stopper circumferential surface, said inner stopper circumferential surface and said outer stopper circumferential surface having a distance greater than the depth of said first retaining groove, and said inner stopper circumferential surface having a curvature substantially identical to that of said first retaining grove, wherein said axial movement stopper is capable of being disposed in relation with said core body and said core housing in such a manner that said inner stopper circumferential surface engages with said first retaining groove while said outer stopper circumferential surface presses against said rear housing end of said core housing in order to enhance structural resistance against an axial force for pulling said lock core out of said lock sleeve; and a structure-reinforcing element adapted for fittedly placing in a reinforcement receptacle formed at said rear core end of said core body to enclose said key receptacle at said rear core end, wherein said structure-reinforcing element is more inelastic than said core body so that said structure-reinforcing element is capable of resisting radial deformation of said rear core end of said core body as said axial force is applied to pull said lock core out of said lock sleeve.

2. The lock enhancing device, as recited in claim 1, wherein said structure-reinforcing element is a circular solid member for mounting within said core housing in front of said rear housing end of said core housing at a position in said reinforcement receptacle of said core body to enclose said key receptacle so as to resist said radial deformation of said rear core end of said core body when said axial force is applied to pull said lock core out of said lock sleeve.

3. The lock enhancing device, as recited in claim 2, wherein said axial movement stopper has a ring opening that enables said axial movement stopper to deform in order to flexibly widen said ring opening for facilitating the engagement of said axial movement stopper with said first retaining groove of said core body.

4. The lock enhancing device, as recited in claim 3, wherein said axial movement stopper has a protruded portion integrally protruded from said inner stopper circumferential surface for fittedly engaging with a positioning recess formed on said first retaining groove into said core body, such that said axial movement stopper is capable of engaging with said first retaining groove without substantial rotation movement with respect to said core body by virtue of the engagement of said protruded portion and said positioning recess.

5. The lock enhancing device; as recited in claim 2, wherein said axial movement stopper has a protruded portion integrally protruded from said inner stopper circumferential surface for fittedly engaging with a positioning recess formed on said first retaining groove into said core body, such that said axial movement stopper is capable of engaging with said first retaining groove without substantial rotation movement with respect to said core body by virtue of the engagement of said protruded portion and said positioning recess.

6. The lock enhancing device, as recited in claim 1, wherein said axial movement stopper has a ring opening that enables said axial movement stopper to deform in order to flexibly widen said ring opening for facilitating the engagement of said axial movement stopper with said first retaining groove of said core body.

7. The lock enhancing device, as recited in claim 1, wherein said axial movement stopper has a protruded portion integrally protruded from said inner stopper circumferential surface for fittedly engaging with a positioning recess formed on said first retaining groove into said core body, such that said axial movement stopper is capable of engaging with said first retaining groove without substantial rotation movement with respect to said core body by virtue of the engagement of said protruded portion and said positioning recess.

8. A lock for operation with a key to activate a key bolt, comprising:

a lock core having a cylindrical core body with a rear core end and a key receptacle for receiving said key defined therein, wherein an external thread is formed on said rear core end inwardly from an rear core edge of said rear core end and a first retaining groove is formed adjacent to said external thread at said rear core end;

a lock sleeve having a core housing with a rear housing end defining a core chamber for fittedly receiving said core body therein, and a fin extending from said core housing having tumbler barrels communicating with said core chamber, wherein a plurality of coded tumblers are disposed in said tumbler barrels in such a manner that as said key is inserted into said key receptacle, said coded tumblers are placed at a position allowing said lock core to rotate with respect to said core sleeve;

a transmission lever connected to said lock core in such a manner that said core body drives said transmission lever to rotate simultaneously for activating said key bolt;

a cap nut having a cylindrical circumferential wall with an inner cap surface defining a lever-receiving opening for receiving said transmission lever therethrough, wherein a second retaining groove is formed on a front cap edge of said inner cap surface and an internal thread is formed adjacent to said second retaining groove thereon; and a lock enhancing device, which comprises:

an axial movement stopper formed as a C-shaped ring having an inner stopper circumferential surface and outer stopper circumferential surface, said inner stopper circumferential surface and said outer circumferential stopper surface having a distance greater than the depth of said first retaining groove and said inner stopper circumferential surface having a curvature substantially identical to that of said first retaining grove, wherein said axial movement stopper is disposed in relation with said core body and said core housing in such a manner that said inner stopper circumferential surface engages with said first retaining groove while said outer stopper circumferential surface presses against said rear housing end; and a structure-reinforcing element fittedly placed in a reinforcement receptacle formed at said rear core end of said core body to enclose said key receptacle at said rear core end, wherein said structure-reinforcing element is more inelastic than said core body so that said structure-reinforcing element is capable of resisting radial deformation of said rear core end of said core body as a axial force is applied to pull said lock core out of said lock sleeve, wherein said cap nut is affixed to said rear core end of said core body with said internal thread engaging said external thread in such a manner that said outer stopper circumferential surface of said axial movement stopper is disposed within said second retaining groove, thereby enhancing structural resistance against said axial force for pulling said lock core out of said lock sleeve.

9. The lock, as recited in claim 8, wherein said structure-reinforcing element is a circular solid member mounted within said core housing in front of said rear housing end of said core housing at a position in said reinforcement receptacle of said core body to enclose said key receptacle so as to resist said radial deformation of said rear core end of said core body when said axial force is applied to pull said lock core out of said lock sleeve.

10. The lock, as recited in claim 9, wherein said axial movement stopper has a ring opening that enables said axial movement stopper to deform in order to flexibly widen said ring opening for facilitating the engagement of said axial movement stopper with said first retaining groove of said core body.

11. The lock, as recited in claim 10, wherein said axial movement stopper has a protruded portion integrally protruded from said inner stopper circumferential surface to fittedly engage with a positioning recess formed on said first retaining groove into said core body, such that said axial movement stopper is engaged with said first retaining groove without substantial rotation movement with respect to said core body by virtue of the engagement of said protruded portion and said positioning recess.

12. The lock, as recited in claim 9, wherein said axial movement stopper has a protruded portion integrally protruded from said inner stopper circumferential surface to fittedly engage with a positioning recess formed on said first retaining groove into said core body, such that said axial movement stopper is engaged with said first retaining groove without substantial rotation movement with respect to said core body by virtue of the engagement of said protruded portion and said positioning recess.

13. The lock, as recited in claim 8, wherein said axial movement stopper has a ring opening that enables said axial movement stopper to deform in order to flexibly widen said ring opening for facilitating the engagement of said axial movement stopper with said first retaining groove of said core body.

14. The lock, as recited in claim 8, wherein said axial movement stopper has a protruded portion integrally protruded from said inner stopper circumferential surface to fittedly engage with a positioning recess formed on said first retaining groove into said core body, such that said axial movement stopper is engaged with said first retaining groove without substantial rotation movement with respect to said core body by virtue of the engagement of said protruded portion and said positioning recess.

* * * * *